US006561090B1

(12) United States Patent
Spooner

(10) Patent No.: US 6,561,090 B1
(45) Date of Patent: May 13, 2003

(54) PRINTING PRESS DAMPENER USING STRAIGHT STREAMS AND METHOD OF DAMPENING A PRINTING PRESS

(75) Inventor: Raymond Hildreth Spooner, Merrimack, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/433,160

(22) Filed: Nov. 3, 1999

(51) Int. Cl.[7] ..... B41F 7/24

(52) U.S. Cl. ..... 101/147; 101/132.5; 101/365; 101/366; 239/589; 239/601

(58) Field of Search ..... 101/132.5, 147, 101/148, 365, 366; 118/304, 315; 239/601, 589

(56) References Cited

U.S. PATENT DOCUMENTS

| | | | | |
|---|---|---|---|---|
| 4,064,801 A | | 12/1977 | Switall | |
| 4,198,907 A | | 4/1980 | Switall | |
| 4,649,818 A | | 3/1987 | Switall et al. | |
| 4,738,400 A | | 4/1988 | Irwin | |
| 4,797,686 A | * | 1/1989 | Holder | 346/1.1 |
| 4,815,375 A | | 3/1989 | Switall et al. | |
| 4,932,319 A | | 6/1990 | Switall | |
| 5,025,722 A | | 6/1991 | Switall et al. | |
| 5,518,183 A | * | 5/1996 | Waldrum | 239/460 |
| 5,595,116 A | | 1/1997 | Ohkawara | |
| 6,089,153 A | * | 7/2000 | Regele et al. | 101/147 |
| 6,109,549 A | * | 8/2000 | Radue et al. | 239/533.12 |
| 6,116,516 A | * | 9/2000 | Ganan-Calvo | 239/8 |

* cited by examiner

*Primary Examiner*—Andrew H. Hirshfeld
*Assistant Examiner*—Kevin D. Williams
(74) *Attorney, Agent, or Firm*—Kenyon & Kenyon

(57) ABSTRACT

A press dampening system which applies dampening fluid to a roll or cylinder using high-density straight streams of fluid flow. The term straight stream encompasses a stream of fluid which is primarily laminar, and which produces a minimal amount of spray or droplets. The flow of fluid is not, or is minimally, broken up into droplets. The straight streams, which include a high density of water or dampening fluid, impact against the roll or cylinder and thereafter the straight stream spreads out across the surface of the roll or cylinder in a puddle-like fashion. Each straight stream is created by an orifice—preferably a micro-orifice—which, at an appropriate back pressure upstream of the orifice, causes the water or dampening fluid to emerge from the orifice in a straight stream of relatively laminar flow.

7 Claims, 3 Drawing Sheets

PRINTING PRESS DAMPENER USING STRAIGHT STREAMS AND METHOD OF DAMPENING A PRINTING PRESS

BACKGROUND OF THE INVENTION

1. Field of the Invention

The present invention relates to a dampening system used in printing presses. In particular, the present invention relates to systems for applying a dampening agent to a plate cylinder.

2. Description of the Prior Art

In the field of offset printing presses, it is known to provide a system which is used to dampen the rolls or cylinders used in transferring an inked image to a web or signature. In general, a dampening fluid, such as water or water mixed with other fluids, is transferred to one or more rolls or cylinders of the press, in order to prevent the ink from drying and therefore to ensure effective printing of the image on the web or signature.

Typically, at least one of two techniques are used to transfer dampening fluid to the rolls or cylinders of a printing press. In the first technique, the dampening fluid is sprayed, in the form of droplets, directly onto one of the rolls or cylinders in the printing press. In the second technique, a dampening train is used to transfer dampening fluid to one of the rolls or cylinders in the printing press. A dampening train is one or more rolls closely adjacent to one another in series, which transfer dampening fluid to subsequent, adjacent rolls, and then to the roll or cylinder in the printing press. The dampening fluid is either sprayed—in the form of droplets—onto one of the rolls in the dampening train, or transferred by the rotation of a roll partially immersed in a dampening fluid source. Dampening trains, because of the number of rolls needed to smooth and transfer the dampening fluid, can be expensive and difficult to maintain.

Several systems have been developed in which the dampening fluid is applied directly to a roll or cylinder using spray nozzles. U.S. Pat. Nos. 4,198,907; 4,649,818; 4,815,375; 4,932,319; 5,025,722 and 5,595,116 each describe systems in which a dampening fluid is sprayed onto a roll. In these spray dampening systems, a series of spray nozzles is used to spray dampening fluid, with each nozzle spraying fluid as a mist or droplets in a conical or fan-like pattern. The nozzles are oriented relative to one another so that the spray pattern of each individual nozzle is closely adjacent to each other nozzle, such that the series of nozzles result in full coverage of the roll upon which the dampening fluid is sprayed. If higher flow rates of water or dampening fluid are needed, various systems are in place to ensure even distribution of water or dampening fluid on the surface of the roll or cylinder. For example, in U.S. Pat. No. 4,815,375, a complex mechanical system is described which allows the spacing between adjacent nozzles to be adjusted, so that there is no overlap in the droplet spray patterns from adjacent nozzles, which would result in uneven dampening. Other prior art arrangements use pulsing of the water or dampening fluid, together with smoothing rollers downstream of the spray nozzles, in order to ensure smooth dampening across the roll or cylinder.

SUMMARY OF THE INVENTION

The present invention is a press dampening system which applies dampening fluid to a roll or cylinder using high-density straight streams of fluid flow. As used herein, the term straight stream encompasses a stream of fluid which is primarily laminar, and which produces a minimal amount of spray or droplets. Therefore, in the present invention, the flow of fluid is not, or is minimally, broken up into droplets. In the present invention, the straight streams, which include a high density of water or dampening fluid, impact against the roll or cylinder and thereafter the straight stream spreads out across the surface of the roll or cylinder in a puddle-like fashion. Each straight stream is created by an orifice—preferably a micro-orifice—which, at an appropriate back pressure upstream of the orifice, causes the water or dampening fluid to emerge from the orifice in a straight stream of relatively laminar flow.

A series of orifices can be spaced across the length of a pressure manifold, so that a series of straight streams are created along the length of the roll or cylinder to be dampened. The orifices are preferably micro-orifices, and the back pressure is preferably regulated by control valves. The laminar flow out of the orifices, which create a puddle-like spread of the water or dampening fluid across the surface of the roll or cylinder, allows the fluid to spread across the entire length of the surface of the roll or cylinder. The puddle-like spread of water or dampening fluid across the surface of the roll or cylinder allows the flow of each straight stream to merge into flow of adjacent straight streams with little fluctuation in the quantity of water or dampening fluid across the roll or cylinder. As a result, the present invention enhances the print quality of the printing press, by reducing print quality fluctuations which may be caused by dampening fluid fluctuations on the surface of the roll or cylinder. Furthermore, because the water or dampening fluid from adjacent straight streams mixes on the surface of the roll or cylinder in a puddle-like fashion, the present invention provides advantages over prior art spray-dampening systems.

With prior art spray dampening systems, which rely upon spray droplets to dampen a roll or cylinder, variations in the rate of application of the water or dampening fluid causes overlaps or gaps in the conical or fan-like spray patterns from the spray orifices. In order to prevent gaps or overlaps, complicated mechanical systems are needed to adjust the spacing of the spray orifices relative to one another in prior art systems. In other prior art systems, smoothing rollers are needed to smooth the dampening fluid across the width of the roll or cylinder. In the present invention, because the water or dampening fluid spreads in a puddle-like fashion and mixes on the roll or cylinder surface—as a result of the straight streams—there is no need to adjust spacing between orifices or to smooth the dampening fluid across the roll or cylinder.

BRIEF DESCRIPTION OF THE DRAWING

The foregoing and other features of the present invention will become apparent to those skilled in the art to which the present invention relates from reading the following description with reference to the accompanying drawings, in which.

DETAILED DESCRIPTION OF THE INVENTION

Figure 3:
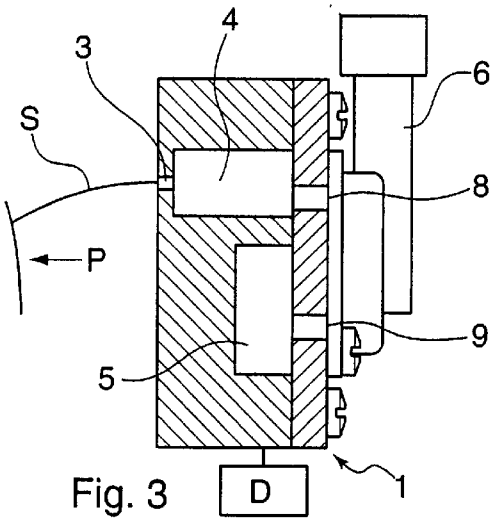
FIG. 3 is a cross-sectional side elevation view of a manifold of FIG. 1.
Figure 2:
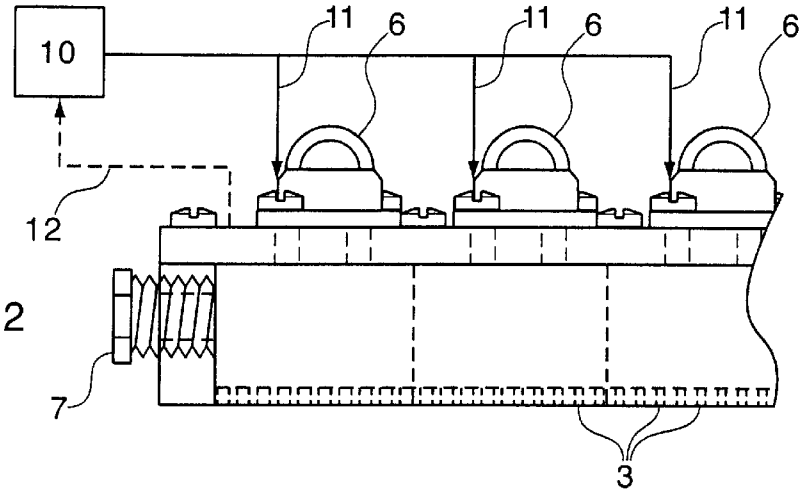
FIG. 2 is a partial top plan view of the manifold of FIG. 1.
Figure 1:
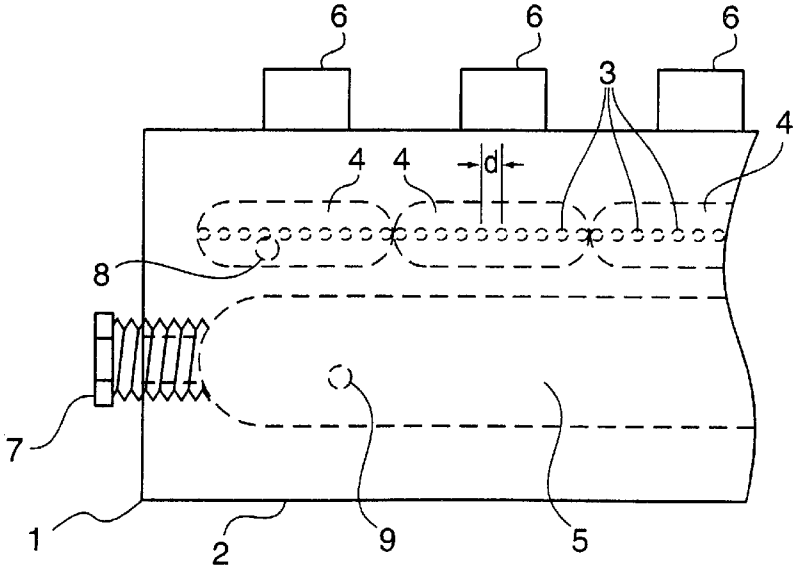
FIG. 1 is a partial front elevation view of a manifold of the present invention.

FIGS. 1 through 3 show a dampening fluid manifold 1 of one embodiment of the present invention. The manifold 1 includes a dampening fluid input passage 5, which preferably extends along the length of the manifold 1 and is connected to a source D of dampening fluid under pressure. A bolt 7 may be used to close off one end of the input passage 5. Input passage 5 supplies dampening fluid under pressure to the manifold 1, for application to a roll or cylinder in a printing press.

A series of outlet passages 9 pass through a wall in the manifold 1. Outlet passages 9 connect the interior of input passage 5 to one of a series of control valves 6 attached to the manifold 1. Outlet passages 9 therefore supply dampening fluid at pressure to the control valves 6. The control valves 6 can be of any known type for controlling the flow of fluid. Control valves 6 are controlled by a controller 10, which may be of any known type, such as a pneumatic or hydraulic control panel, or an electronic microprocessor or other electronic controller. The controller 10 sends signals, along lines 11, to each individual control valve 6, to control the opening and closing, and the degree of opening and closing, of a control valve 6.

Control valves 6 control the flow of dampening fluid from the input passage 5 to inlet passages 8. Inlet passages 8 each lead to one of a series of pressure chambers 4 located along the length of the manifold 1. Accordingly, control valves 6 regulate the pressure in each of the pressure chambers,4. Each of the pressure chambers 4 feed dampening fluid to a group of orifices 3 spaced along the width of the manifold 1. The orifices 3 are spaced from one another by a distance d. The orifices 3 each create a straight stream S of dampening fluid which emerges from the orifice 3 and which impacts upon a roller or cylinder, such as a plate cylinder P.

The orifices 3 are preferably micro-orifices, i.e., have an opening of a very small size. The orifices 3 could be machined directly into a side of the manifold 1, or could be a fabricated component which is inserted into a machined opening in the side of the manifold 1. As will be discussed in detail below, the orifices 3 are sized such that they will produce a high-density, straight stream S of dampening fluid—in particular, a stream composed primarily of laminar flow—at a range of back pressures that will be produced within the pressure chambers 4 by the control valves 6.

In order to ensure that the orifices 3 produce high-density straight streams of dampening fluid, the back pressure within the pressure chambers 4 can be controlled to be within suitable ranges that will produce primarily laminar flow out of the orifices 3, all of which are of fixed size. The pressure in the pressure chambers 4 is regulated by the control valves 6, which in turn are controlled by controller 10. A feedback system 12, which may be coupled to a pressure transducer (not shown) within the pressure chambers 4 for monitoring the back pressure, may be used to ensure that the pressure within pressure chambers 4 is within an appropriate range so as to produce straight streams from the orifices 3, which are of a known size. Within that pressure range, the pressure in pressure chambers 4 may be regulated by the controller so as to provide different flow rates of dampening fluid. In this way, the flow rate of dampening fluid may be adjusted, to account for differing conditions which may require more or less dampening fluid on a roll or cylinder in the printing press.

Figure 4:
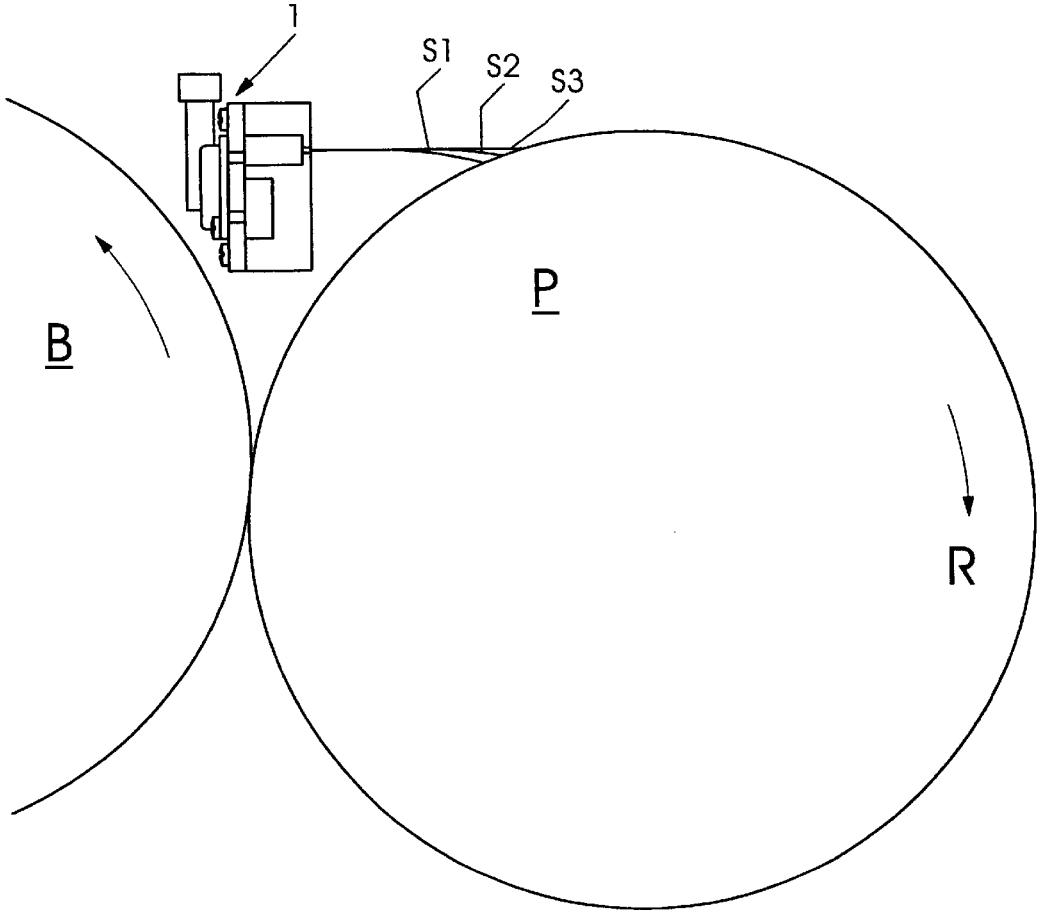
FIG. 4 is a schematic side elevational view of the manifold of the present invention in use in a printing press.

FIG. 4 shows the manifold 1 of the present invention in place so as to dampen a plate cylinder P, rotating in a direction R, which transfers ink to a blanket cylinder B in an offset printing press. As shown in FIG. 4, the manifold 1 is oriented so as to transfer dampening fluid onto the surface of the plate cylinder P in the form of high-density straight streams of dampening fluid. Depending on the back pressure in the pressure chambers 4, the flow rate and velocity of the dampening fluid out of the orifices 3 can differ, such that differing stream profiles $S_1$ (low flow rate), $S_2$ (medium flow rate) or $S_3$ (high flow rate) are produced. The flow rates out of the orifices 3 are regulated by the control valves 6 for each pressure chamber 4. The differing flow rates will control the rate at which dampening fluid is applied to the surface of the plate cylinder P. In this way, the amount of dampening of the plate cylinder P may be regulated, while still ensuring that straight streams are produced by the manifold 1 and orifices 3.

Figure 5:
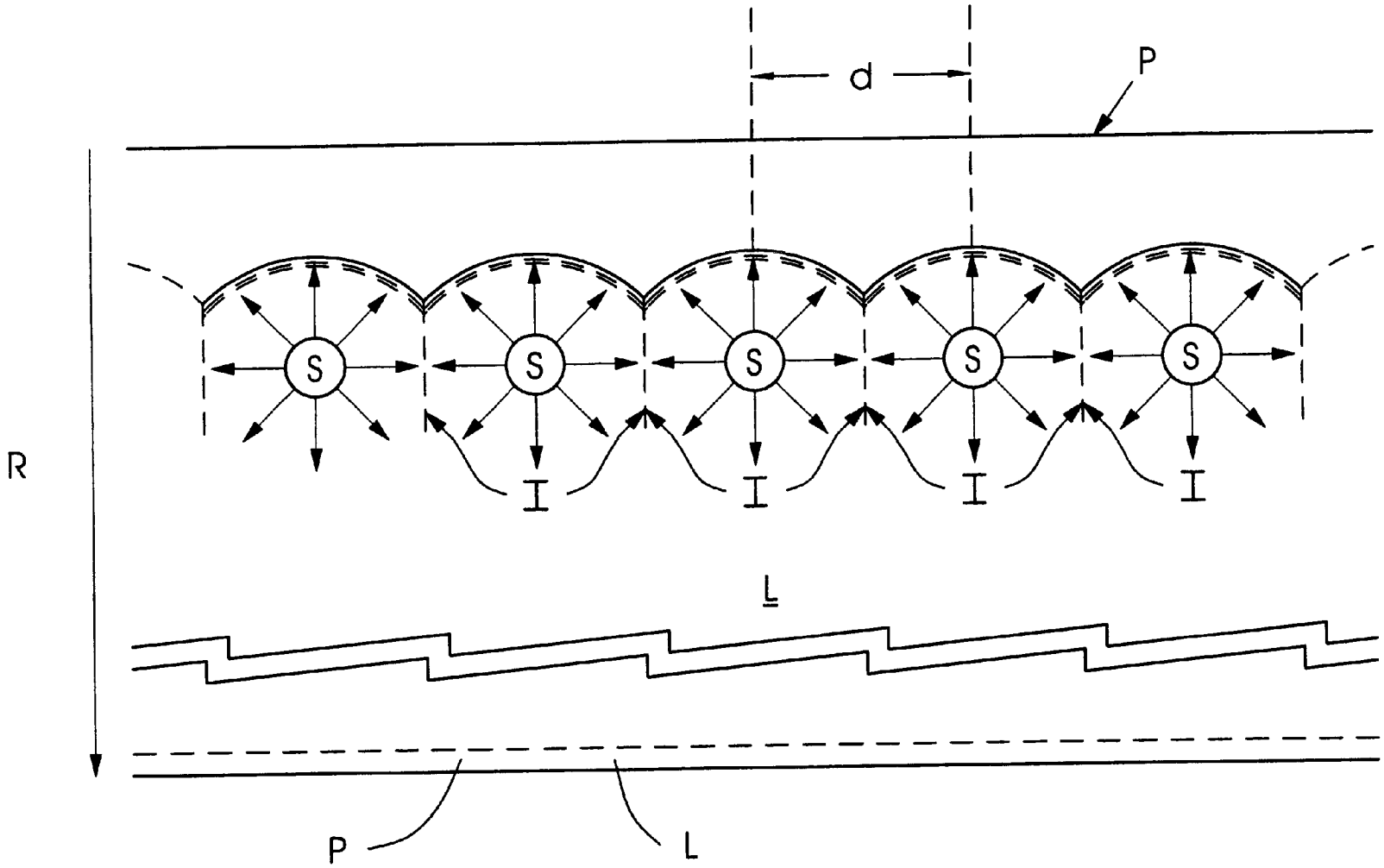
FIG. 5 is a side elevational view of the dampened cylinder of the present invention, showing the manner in which the dampening fluid spreads.

The orifices 3 are spaced from one another such that the straight streams S produce uniform application of dampening fluid across the surface of the roll or cylinder which is dampened. FIG. 5 is a representation of how the dampening fluid is applied to the surface of the plate cylinder P. The straight streams S, which are shown cross-sectionally at the point of impact on the plate cylinder P, produce a puddle-like spread of the dampening fluid in the directions shown by the arrows. As the dampening fluid spreads out from the point of impact of the straight stream S in a puddle-like fashion, the dampening fluid will flow into the spreading dampening fluid from an adjacent straight stream S, at an intersection area I. The distance d is selected so that the spreading dampening fluid will flow into the spreading dampening fluid from an adjacent straight stream S, at the various flow rates which can be produced through the orifices 3, without gaps. Downstream of the point of impact of the straight streams S, the dampening fluid forms a dampening layer L which spreads across the length of the plate cylinder P, thereby dampening the plate cylinder P in a uniform fashion.

In the above description of the invention, those skilled in the art will perceive improvements, changes and modifications. Improvements, changes and modifications within the skill of the art are intended to be covered by the claims.

What is claimed is:

1. A method of dampening a component in a printing press, comprising:

passing a dampening fluid through at least one orifice;

producing at least one straight stream of the dampening fluid through the at least one orifice;

spreading dampening fluid on the component using the at least one straight stream.

2. The method of claim 1, wherein:

the dampening fluid is passed through a plurality of orifices, to thereby produce a plurality of straight streams.

3. The method of claim 1, wherein:

the dampening fluid spreads on a cylinder in the printing press.

4. The method of claim 1, further comprising:

controlling a back pressure of the dampening fluid upstream of the at least one orifice.

5. The method of claim 4, further comprising:

monitoring the back pressure.

6. The method of claim 4, wherein:

the back pressure is controlled using at least one control valve.

7. The method of claim 4, further comprising:

controlling the back pressure so as to regulate an amount of dampening fluid provided to the component.

* * * * *